United States Patent [19]

Pierlot

[11] 3,931,372

[45] Jan. 6, 1976

[54] CARBURETTORS FOR INTERNAL COMBUSTION ENGINES

[75] Inventor: Michel Eugene Pierlot, Le Pecq, France

[73] Assignee: Societe Industrielle de Brevets et d'Etudes S.I.B.E., Neuilly-sur-Seine, France

[22] Filed: Nov. 13, 1974

[21] Appl. No.: 523,491

[30] Foreign Application Priority Data

Nov. 21, 1973 France ..... 73.41413

[52] U.S. Cl. ..... 261/41 D; 261/121 B; 261/63

[51] Int. Cl.[2] ..... F02M 3/06

[58] Field of Search ..... 261/41 D, 121 B, 63

[56] References Cited

UNITED STATES PATENTS

| | | | |
|---|---|---|---|
| 2,925,256 | 2/1960 | Carlson | 261/63 |
| 3,425,672 | 2/1969 | Seigel et al. | 261/121 B |
| 3,454,264 | 7/1969 | Sarto | 261/41 D |
| 3,608,874 | 9/1971 | Beckmann | 261/41 D |
| 3,711,069 | 1/1973 | Hideg et al. | 261/121 B |
| 3,878,271 | 4/1975 | Garcea | 261/41 D |

FOREIGN PATENTS OR APPLICATIONS

| | | | |
|---|---|---|---|
| 1,217,948 | 1/1971 | United Kingdom | 261/41 D |

*Primary Examiner*—Tim R. Miles

*Attorney, Agent, or Firm*—Stevens, Davis, Miller & Mosher

[57] ABSTRACT

A carburettor comprises an idling circuit having an idling duct delivering a fuel air mixture into the intake conduit and an air duct. The air duct has a restricted passage provided with an adjusting screw. The idling duct is connected to a second passage of the air duct whose section is manually adjustable by the adjusting screw simultaneously with the first passage.

8 Claims, 2 Drawing Figures

CARBURETTORS FOR INTERNAL COMBUSTION ENGINES

BACKGROUND OF THE INVENTION

The invention relates to internal combustion engine carburettors, more particularly to carburettors which comprise, for feeding the engine at idling speed, a first duct (called hereinafter an idling duct) which is connected to a source of fuel and to atmosphere via respective calibrated orifices, and which has downstream a third calibrated orifice which is adjustable in cross-section, and a second duct (called hereinafter an air duct) which is connected upstream to atmosphere via a passage having means for controlling its section, the two ducts being connected downstream to that zone of the carburettor intake conduit which is disposed downstream of the main throttle member of the intake conduit, so that the underpressure present in that zone when the throttling member is in the idling speed position causes a rich mixture of fuel and air to flow along the idling duct, and air for diluting the mixture before it is admitted to the engine to flow along the air duct.

A carburettor of that type is disclosed in British Pat. No. 1 217 948 assigned to the assignee of the present invention. In that carburettor, the air duct is connected to a point of the idling speed duct located between the air intake of such duct and the passage of adjustable section, so that any variation in the air flow in such air duct is accompanied by a variation in the same direction of the fuel flow rate of the idling duct.

That prior art arrangement is intended to maintain a substantially constant richness of the mixture supplied to the engine at idling speed when the air flow in the air duct is varied by adjusting the section control means. It gives satisfactory results as long as the variation in air flow in the air duct is low enough; on the other hand, the mixture supplied to the engine has a tendency to be too lean for a low air flow and too rich for a high air flow in the air duct when the range of variation is considerable. In the case of engines with a large cylinder volume, the range of variation in the air flow to be provided is relatively low and enables a substantially constant richness to be maintained for all idling speeds, from the fast idling speed to be provided for a brand new engine to the normal idling speed of a run-in engine. On the other hand, for engines having a small cylinder volume (particularly below 1000 $cm^3$), the air flow during idling is much higher when the engine is brand new than when the engine has been run-in, and there is a modification in richness.

SUMMARY OF THE INVENTION

It is an object of the invention to provide carburettors in which the richness of the mixture supplied to the engine remains substantially constant for an increased range of variation in the air flow used for controlling the idling speed.

For that purpose, the air duct is so connected to the idling duct that the latter discharges into a second passage of the air duct whose cross-section can be modified by adjusting means at the same time as the first passage, the second passage being disposed upstream of the first passage in the air duct. The adjusting means and passages are given a shape and arrangement such that the second passage always offers to the air flow a larger flow section than that of the first passage.

Other objects and features of the invention will more clearly appear from the following description of an inverted carburettor forming a particular embodiment of the invention, given by way of non-limitative example.

SHORT DESCRIPTION OF THE DRAWINGS

DETAILED DESCRIPTION OF PREFERRED EMBODIMENTS

Figure 1:
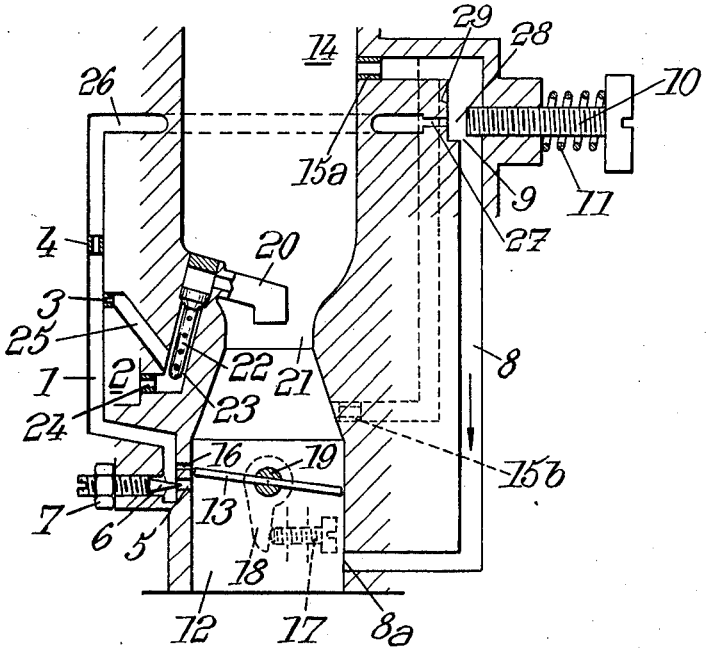
FIG. 1 is a diagrammatic vertical section of the carburettor.

Referring to FIG. 1, the carburettor comprises an idling duct 1 and an air duct 8. The inlet of the idling duct 1 is connected to a fuel source 2 (such as a constant level float chamber) and to atmosphere via respective calibrated orifices 3 and 4 and its outlet is provided with a third calibrated orifice 5 whose cross-section is manually adjustable for example with a screw 6 which can be locked by a nut 7. The air duct 8 has an inlet connected to atmosphere via a first passage 9 having means for adjusting its cross-section (such as a screw 10 which can be retained in position by a spring 11 or the like).

In the embodiment illustrated in FIG. 1, the first passage 9 is formed as a throttled zone between the screw 10 and the edge of a shoulder limiting a widened portion of the duct 8 and located just downstream of the screw 10 in the duct 8. Ducts 1 and 8 open downstream into that zone of the intake conduit 12 of the carburettor which is downstream of an operator actuatable throttle valve 13.

The intake conduit 12 has in its general air intake 14 an air filter (not shown). In the embodiment illustrated in FIG. 1 the air duct is connected to a zone of the intake 14 located downstream of the air filter, via a calibrated orifice 15*a*. In other embodiments, the air duct 8 can be connected to an orifice 15*b* disposed immediately downstream of venturi 21, upstream of the throttling member 13 (this arrangement being shown by chain lines in FIG. 1). When the air duct is fed by an orifice disposed at 15*a*, it receives atmospheric air which is substantially at atmospheric pressure; on the other hand, when it is fed by an orifice disposed at 15*b*, such pressure is reduced by the venturi when the air flow in the intake conduit 12 is considerable.

In addition to the orifice 5, the duct 1 can be connected to the conduit 12 by at least one conventional transfer orifice 16 so disposed as to pass from upstream to downstream of the throttle member 13 when the latter is moved from its closure position shown in FIG. 1. The orifice or orifices 16 are intended to maintain a correct air-fuel mixture as the throttle member 13 opens.

Although it is not required for understanding the invention, FIG. 1 also shows part of the supply circuit for on-load operation of the engine. The circuit comprises a fuel jetting system 20 discharging into the venturi 21 of the conduit 12 and which is fed with a primary mixture of air and fuel by an emulsion tube 22. The latter is immersed in a well 23 which receives fuel from the chamber 2 via a calibrated orifice 24 and air via another orifice (not shown). The fuel for the idling circuit can be taken from the well 23 - i.e. downstream of the calibrated orifice 24 -, via a duct 25 provided with the calibrated orifice 3.

For idling speed operation, the throttle member 13 is retained in a minimum opening position determined by a stop screw 17 co-operating with a lever 18 securely connected to the member 13 by the axle 19.

In conventional carburettors, the air for diluting the rich idling speed mixture fed through the duct 1 flows through the annular clearance left free between the wall of the conduit 12 and the lateral edge of the throttle member 13 whose degree of opening is determined by the screw 17. In the carburettor of the present invention, the cross-sectional area of this annular passage may be considerably reduced so that the greater part of the diluting air for idling is fed via the duct 8.

The air duct 8 opens via an orifice 8*a* into that zone of the intake conduit 12 which is downstream of the throttle member 13. The air duct 8 also delivers air to a zone of the idling duct located upstream of the calibrated orifice 4 thereof via a passage of adjustable cross-section. To that end the idling speed duct 1 comprises beyond the orifice 4 an extension 26 which opens via an orifice 27 into a second passage 28 bounded, in the embodiment illustrated in FIG. 1, by a wall 29 of the widened zone of the duct 8 and by the end face of the screw 10. The position of the screw 10, the shape and size of the widened portion are such that the sections of the two passages vary in the same direction when the screw is actuated, the passage 28 however always remaining wider than the passage 9.

The carburettor operates and is adjusted as follows. After adjusting the idling conditions of the carburettor (generally in the factory workshop) to obtain a mixture of predetermined richness, the screw 17 is locked, thus determining the minimum opening of the throttle member 13. The screw 10 is approximately adjusted for obtaining the idling speed air flow at a value corresponding to the particular engine which is to be equipped with the carburettor. The screw 6 is adjusted and locked in a position which determines a section of the orifice 5 corresponding to a rate of carbon monoxide in the exhaust gases which is within acceptable limits, the screw 10 having been pre-adjusted.

Now, the adjustment of the screw 10 may be trimmed for modifying the air flow sucked in by the engine at idling speed and, for instance, increasing it if, with a brand new engine, the internal resistances of the engine are such that the idling speed designed for run-in engine is too slow: in that case, the screw 10 is loosened to increase the air flow through the air duct 8.

Figure 2:
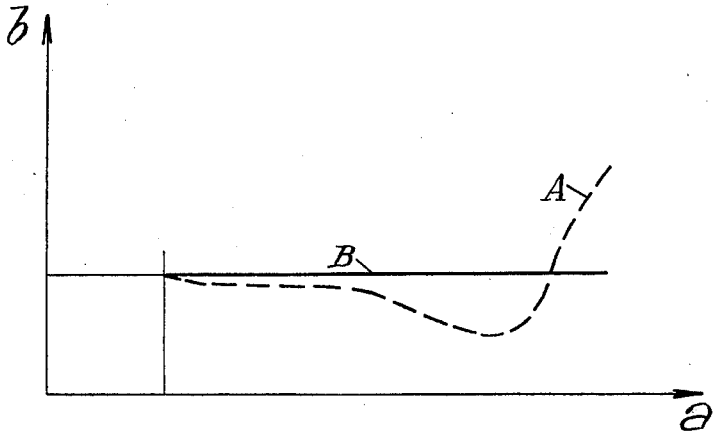
FIG. 2 is a graph illustrating the operation of the carburettor illustrated in FIG. 1.

To illustrate the results obtained by the invention, FIG. 2 shows two curves A, B showing the variation in richness *b* of the fuel-air mixture fed to the engine (in kg of fuel per kg of air, for instance) plotted against the air flow *a* introduced into the engine (in kg of air per hour, for instance). The dotted curve A shows the variation when the duct 26 discharges into a passage of invariable section of the duct 8, upstream of the passage 9 of adjustable section as in prior art arrangements: after a range in which the richness is almost constant, the mixture becomes too lean and then of excessive richness. On the other hand, when the duct 26 discharges into passage 28 via an orifice 27 which confronts the end face of the screw 10 projecting into the duct 8, a substantially horizontal curve is obtained (curve B) over a range three to four times more extensive than in the preceding case. This advantage may be attributed to the fact that since the orifice 27 is level with the passage 28, the underpressure at the orifice 27 varies substantially in direct proportion with the air flow passing through the duct 8 whereas, if the orifice 27 discharges upstream of the passage 9, the underpressure of such orifice 27 varies in proportion with the square of the air flow in the duct 8.

The arrangement according to the invention therefore very simply allows the excess richness found for high air flows to be eliminated and a richness to be obtained which is substantially constant over a large variation of the idling speed air flow corresponding, for instance, to the range 800 – 1800 t/min, instead of 800 – 1100 t/min.

Also, by suitable selection of the calibrating orifices 3, 4, the richness could be caused to increase or decrease slightly in dependence on the air flow, if required.

The proportional relationship between the air flow and the underpressure would disappear if the flow in the passage 28 became sonic. This risk is obviated if the passage 9 is given a cross-section such that, whatever the position of the screw 10 may be, the cross-section is smaller than that of the passage 28, since it is the passage 9 which exerts the essential limiting action on the air flow through the passage 9.

I claim:

1. In a carburettor for an internal combustion engine having an intake conduit and an operator operable throttle member in said conduit, an idling circuit comprising: an idling duct connected to a source of fuel and to a source of atmospheric air via respective calibrated orifices and formed with an adjustable orifice located downstream of said calibrated orifices on the path of air and fuel; an air duct having an inlet connected to receive atmospheric air and formed with a first passage having means for adjusting its cross-section, both said ducts having respective outlets opening into a zone of said intake conduit which is located downstream of the throttle member for the underpressure prevailing in that zone when the throttle member is in an idling position to draw a rich mixture of fuel and air via the idling speed duct and dilution air via the air duct, wherein the idling duct is connected to a second passage of the air duct whose section is adjustable by said adjusting means simultaneously with the first passage, said second passage being located upstream of the first passage in the direction of flow of air in said air duct.

2. A carburettor as set forth in claim 1, wherein said adjusting means and passages are constructed for the cross-section of said second passage to be greater than the cross-section of the first passage whatever the position of the adjusting means.

3. A carburettor as set forth in claim 2, wherein the air duct has an inlet connected to a section of the carburettor air intake which is located downstream of an inlet air filter and upstream of said throttling member.

4. A carburettor as set forth in claim 2, wherein the air duct has an inlet connected to the section of the intake conduit which is located downstream of a venturi thereof and upstream of said throttling member.

5. A carburettor as set forth in claim 2, wherein said first passage is limited by said adjusting means and by a shoulder in the wall of said air duct which limits an enlarged portion thereof.

6. A carburettor as set forth in claim 5, wherein said idling duct opens into said air duct through an orifice in the wall of the enlarged portion thereof which confronts an end portion of said adjusting means.

7. A carburettor according to claim 6, wherein said adjusting means comprises a screw projecting by an adjustable extent into said enlarged portion toward said orifice.

8. A carburettor according to claim 7, wherein said screw is provided with a braking spring.

* * * * *